US012357090B2

(12) United States Patent
Lee et al.

(10) Patent No.: US 12,357,090 B2
(45) Date of Patent: Jul. 15, 2025

(54) PUSH-TO-OPEN DEVICE

(71) Applicant: SEGOS CO., LTD., Incheon (KR)

(72) Inventors: Doo Myun Lee, Incheon (KR); Duc Hoi Kim, Incheon (KR); Ro Hee Lee, Incheon (KR); Sai Ryun Kim, Incheon (KR); Byeol Kim, Seoul (KR)

(73) Assignee: SEGOS CO., LTD., Incheon (KR)

( * ) Notice: Subject to any disclaimer, the term of this patent is extended or adjusted under 35 U.S.C. 154(b) by 116 days.

(21) Appl. No.: 18/267,973

(22) PCT Filed: Dec. 9, 2021

(86) PCT No.: PCT/KR2021/018631
§ 371 (c)(1),
(2) Date: Jun. 16, 2023

(87) PCT Pub. No.: WO2022/139269
PCT Pub. Date: Jun. 30, 2022

(65) Prior Publication Data

US 2024/0108135 A1 Apr. 4, 2024

(30) Foreign Application Priority Data

Dec. 23, 2020 (KR) ..... 10-2020-0182195

(51) Int. Cl.
*A47B 88/463* (2017.01)
*A47B 88/427* (2017.01)
*A47B 88/497* (2017.01)

(52) U.S. Cl.
CPC ..... *A47B 88/463* (2017.01); *A47B 88/427* (2017.01); *A47B 88/497* (2017.01); *A47B 2088/4276* (2017.01)

(58) Field of Classification Search
CPC ..... A47B 88/46; A47B 88/427; A47B 88/463; A47B 88/497; A47B 2088/4276
See application file for complete search history.

(56) References Cited

U.S. PATENT DOCUMENTS 8,240,788 B2 * 8/2012 Juan ..... A47B 88/49 312/333
8,307,497 B2 * 11/2012 Chang ..... E05F 5/003 16/49

(Continued)

FOREIGN PATENT DOCUMENTS

CN 111743329 A 10/2020
DE 20 2005 002 433 U1 5/2005

(Continued)

OTHER PUBLICATIONS

International Search Report for PCT/KR2021/018631 dated Mar. 11, 2022 (PCT/ISA/210).

(Continued)

*Primary Examiner* — James O Hansen
(74) *Attorney, Agent, or Firm* — Sughrue Mion, PLLC

(57) ABSTRACT

Provided is a push-to-open device mounted on a slide device having a fixed rail and a movable rail slidably provided on the fixed rail, and provides a push-to-open device including: a main body mounted on the fixed rail, and having a guide path and an inner space; a slider, which is provided on the main body so as to be capable of being caught by or released from a catching member of the movable rail, and moves along the guide path; a shaft, which has one end connected to the slider and the other end connected to an elastic member provided at the main body, and has a plurality of operating protrusions protruding from the outer peripheral surface thereof and a plurality of catching protrusions protruding at positions spaced a predetermined distance from the operating protrusions in the longitudinal direction; and a rotator.

8 Claims, 10 Drawing Sheets

(56) References Cited

U.S. PATENT DOCUMENTS

| | | | |
|---|---|---|---|
| 9,388,619 | B2 | 7/2016 | Park et al. |
| 2012/0153792 | A1 | 6/2012 | Yu et al. |
| 2015/0204129 | A1 | 7/2015 | Park et al. |

FOREIGN PATENT DOCUMENTS

| | | | |
|---|---|---|---|
| JP | 2004-057567 | A | 2/2004 |
| KR | 10-2011-0016806 | A | 2/2011 |
| KR | 10-1391247 | B1 | 5/2014 |
| KR | 10-1398127 | B1 | 5/2014 |
| KR | 10-2017-0122361 | A | 11/2017 |
| KR | 10-1810445 | B1 | 12/2017 |
| KR | 10-1955887 | B1 | 3/2019 |
| WO | 2015/008980 | A1 | 1/2015 |

OTHER PUBLICATIONS

Extended European Search Report dated Mar. 21, 2024 in Application No. 21911336.2.

* cited by examiner (a)

(b)

(a)

(b)

PUSH-TO-OPEN DEVICE

CROSS REFERENCE TO RELATED APPLICATIONS

This application is a National Stage of International Application No. PCT/KR2021/018631 filed Dec. 9, 2021, claiming priority based on Korean Patent Application No. 10-2020-0182195 filed Dec. 23, 2020, the entire disclosures of which are incorporated herein by reference.

TECHNICAL FIELD

The present invention relates to a push-to-open device, and more particularly, to a push-to-open device that is applied to a slide rail of a drawer and is automatically opened while unlocked by a drawer pushing operation.

BACKGROUND ART

In general, sliding-type storage bodies are provided to be opened or closed in a sliding manner in a main body of any of furniture, refrigerators, or various arrangement boxes and store necessary articles.

This sliding-type storage body has a storage body installation space in the main body and is opened or closed by sliding devices arranged on an inner wall of the installation space and both sides of the storage body and installed slidably in a mutual rolling contact manner.

For example, when a user wants to close the storage body as needed, the storage body is pushed and moved in a closing direction, and when the user wants to open the storage body, the storage body is touched, partially protrudes from the main body by an elastic reaction, and thus can be pulled and used manually.

However, according to the related art, in a process of touching and opening the storage body, an unlocking section becomes longer, a space between the main body and the storage body is excessively widened, and thus it is difficult to sufficiently secure a storage space. Further, since a structure is complicated due to many components, functional errors and noise occur.

RELATED ART DOCUMENT (Patent Document 1) Korean Patent Registration No. 10-1810445 (registered on Dec. 16, 2017)

DISCLOSURE

Technical Problem

The present invention is directed to providing a push-to-open device that is applied to a slide rail of a drawer and is automatically opened while unlocked by a drawer pushing operation.

Technical Solution

One aspect of the present invention provides a push-to-open device mounted on a slide device having a fixed rail and a movable rail slidably installed on the fixed rail, the push-to-open device including a main body mounted on the fixed rail and having a guide path and an internal space, a slider that is provided on the main body to be locked with or unlocked from a locking member of the movable rail and moves along the guide path, a shaft of which one end is connected to the slider and the other end is connected to an elastic member provided in the main body and which has a plurality of operation protrusions protruding from an outer circumferential surface thereof and a plurality of locking protrusions protruding from positions spaced a predetermined distance from the operation protrusions in a lengthwise direction, a rotator that is provided in the main body, rotates in one direction while engaged with the operation protrusion by movement of the shaft during a pushing operation, and accordingly, is repeatedly locked with and unlocked from the locking protrusion, and the elastic member that is provided in the main body and elastically supports a locking or unlocking operation of the shaft and the rotator.

The slider may include a locking groove that is recessed and locked with or unlocked from the locking member, a locking step formed in front of the locking groove, and a shaft connection groove into which a head of the shaft is inserted and coupled.

The locking step may include a first upper inclination portion that allows the locking member to be smoothly separated from the locking groove when the movable rail is forcibly extracted.

The locking step may further include a first side inclination portion that allows the locking member to be smoothly separated from the locking groove when the movable rail is forcibly extracted.

The rotator may include a plurality of ratchet protrusions formed in an "H" shape on an inner circumferential surface of the rotator, and a plurality of passages formed between the ratchet protrusions.

The ratchet protrusions may include a first ratchet protrusion of which both ends are formed in an oblique shape and which is engaged with the operation protrusions and the locking protrusions, a second ratchet protrusion which is disposed parallel to the first ratchet protrusion, of which both ends are formed in an oblique shape, and which is engaged with the operation protrusions and the locking protrusions, and a blocking protrusion which connects the first ratchet protrusion and the second ratchet protrusion and with which the locking protrusion is locked during a locking operation.

One end of the operation protrusion may be formed to correspond to the oblique shapes of the first ratchet protrusion and the second ratchet protrusion, and one end of the locking protrusion may be formed to correspond to the oblique shapes of the first ratchet protrusion and the second ratchet protrusion.

The body may include a body mounted on the fixed rail, having the guide path formed therein, and having a fastening protrusion provided at one end thereof, and a housing into which the fastening protrusion is inserted and coupled, and accordingly, which has a rotational space part, in which the rotator is rotatably disposed, formed therein.

The guide path may include a straight guide portion extending in a lengthwise direction thereof, and a curved guide portion extending to be curved downward at one end of the straight guide portion.

Advantageous Effects

According to an aspect of the present invention, in a push-to-open device according to the present invention, a storage body is locked or unlocked by a pushing operation, and thus user convenience can be improved even without a separate handle, and external appearance of the storage body can be improved.

Further, in the push-to-open device according to the present invention, a structure thereof is simplified and the number of components is reduced, and thus malfunction can be prevented and assembly convenience can be improved.

The effects of the present invention are not limited to the above effects and should be understood to include all effects that may be deduced from the detailed description of the present invention or the configuration of the present invention described in the appended claims.

MODES OF THE INVENTION

Figure 1:
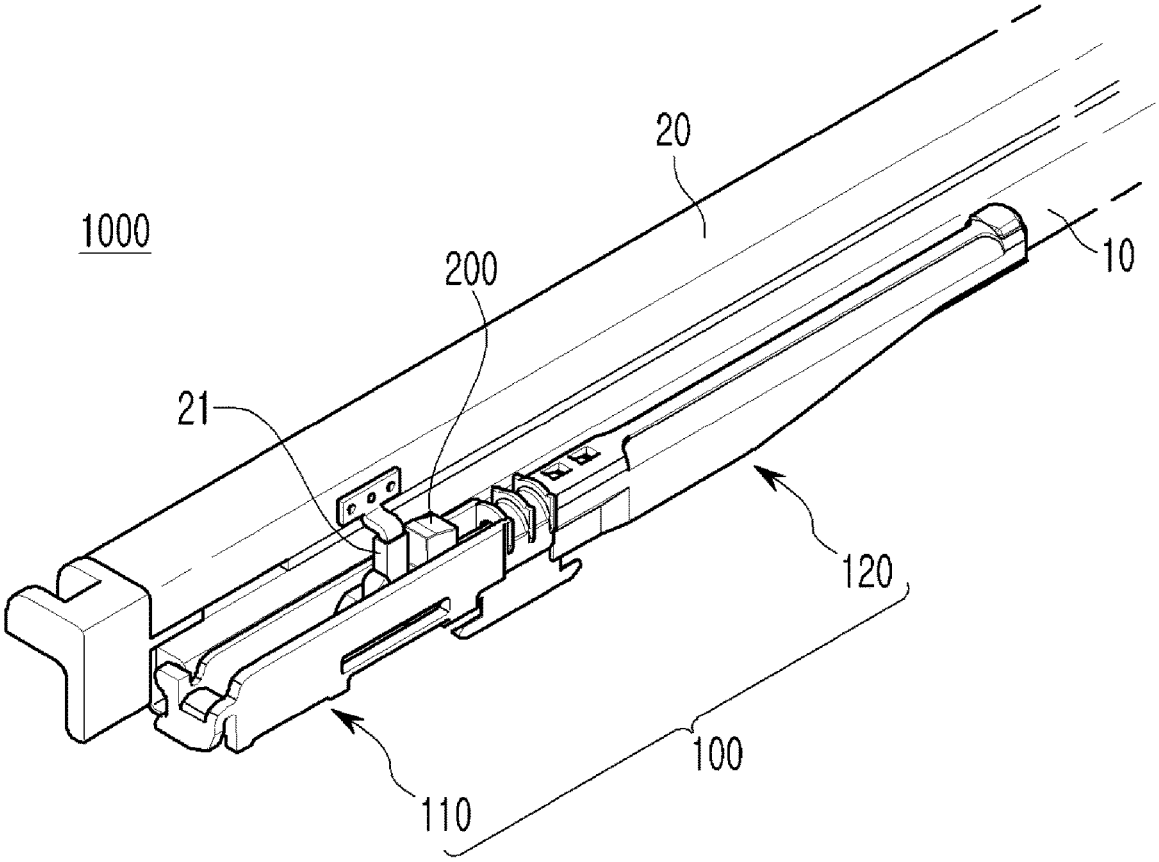
FIG. 1 is a perspective view of a push-to-open device according to an embodiment of the present invention.

Hereinafter, the present invention will be described with reference to the accompanying drawings. However, the present invention may be implemented in various different forms and thus is not limited to embodiments described herein. Further, in the drawings, parts irrelevant to the description are omitted in order to clearly describe the present invention, and throughout the specification, similar reference numerals are assigned to similar parts.

Throughout the specification, when a first part is connected to a second part, this includes not only a case in which the first part is "directly connected" to the second part but also a case in which the first part is "indirectly connected" to the second part with a third part interposed therebetween. Further, when a part "includes" a component, this means that another component is not excluded but may be further included unless otherwise stated.

Hereinafter, embodiments of the present invention will be described in detail with reference to the accompanying drawings.

Figure 2:
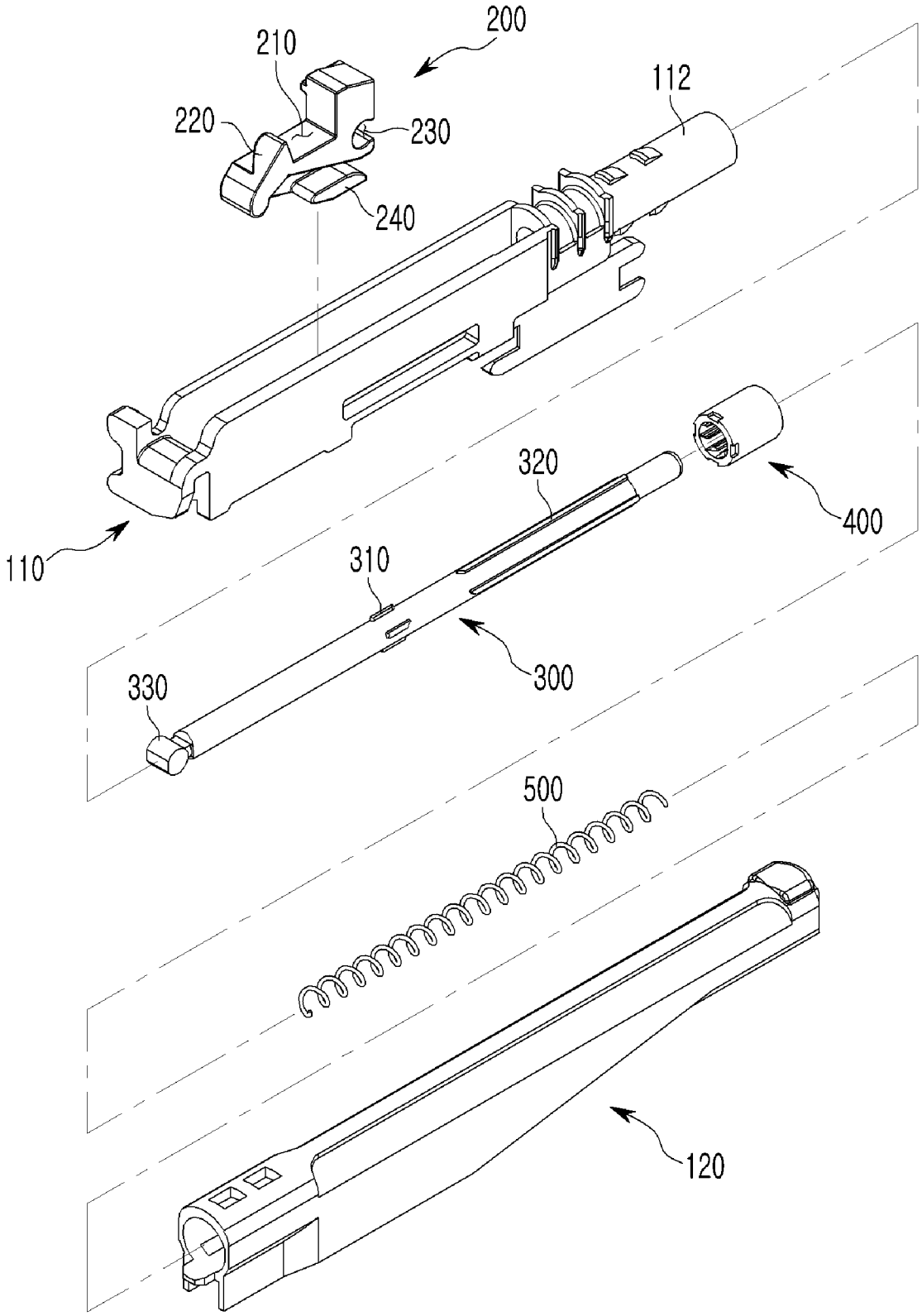
FIG. 2 is an exploded view of the push-to-open device according to the embodiment of the present invention.
Figure 3:
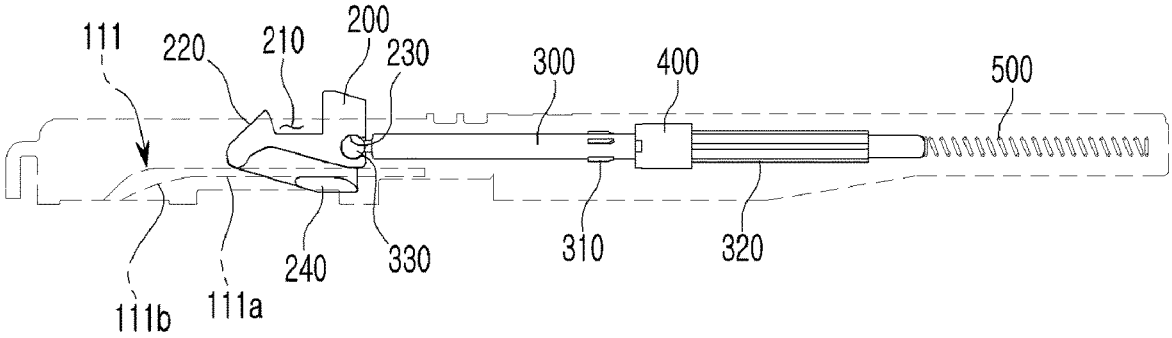
FIG. 3 is a front view of the push-to-open device according to the embodiment of the present invention.
Figure 4:
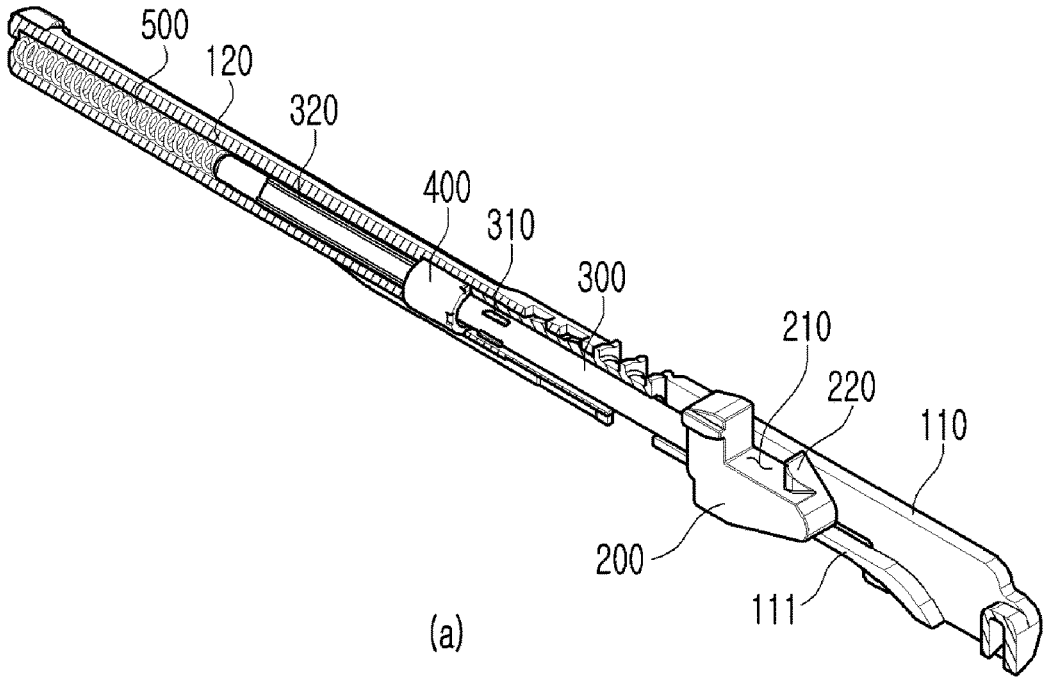
FIG. 4 is a cutaway view of the push-to-open device according to the embodiment of the present invention.
Figure 4:
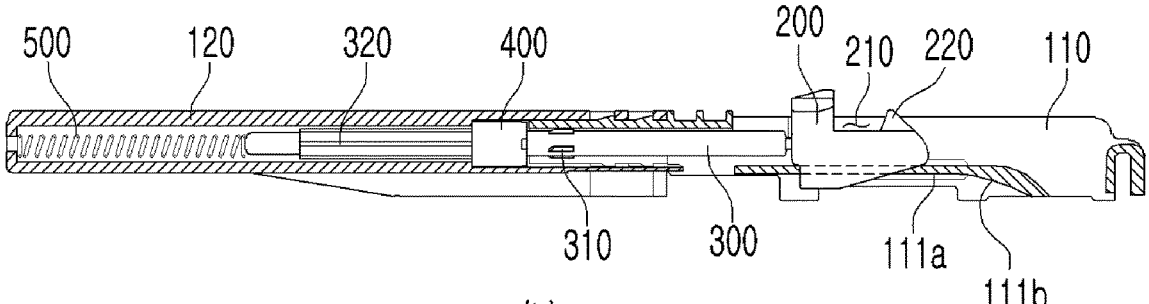
Figure 5:
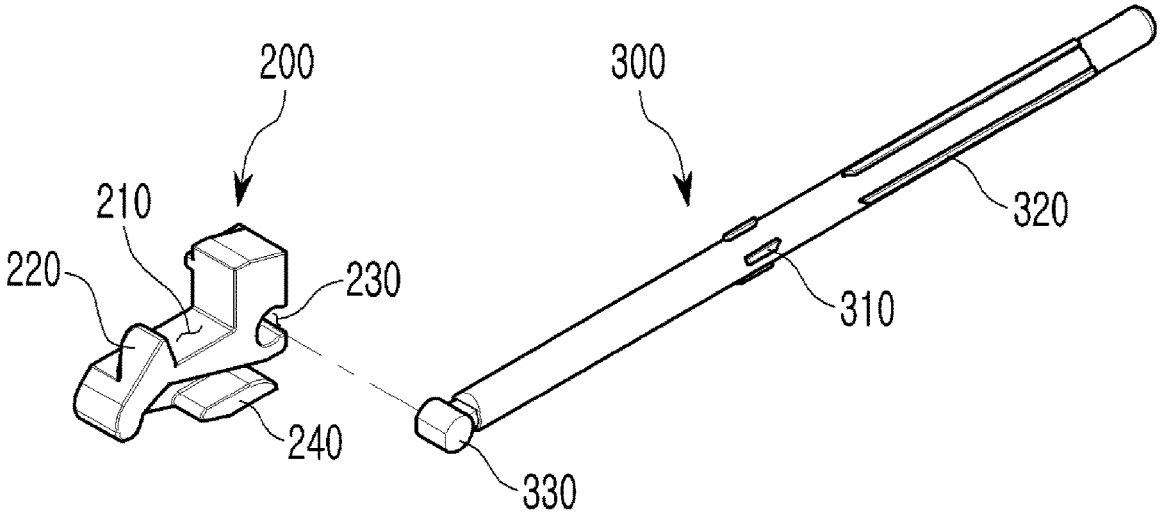
FIG. 5 is an exploded perspective view of a slider and a shaft according to the embodiment of the present invention.
Figure 6:
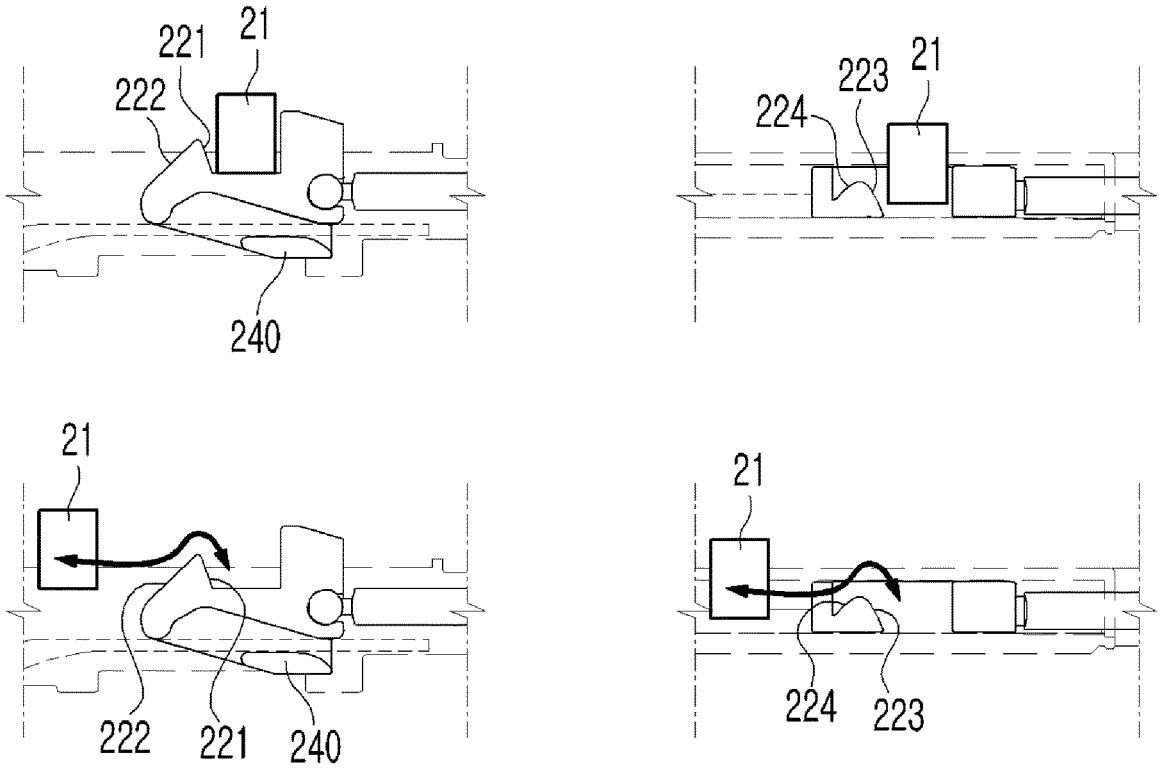
FIG. 6 illustrates an operation process when a movable rail is forcibly extracted according to the embodiment of the present invention.
Figure 7:
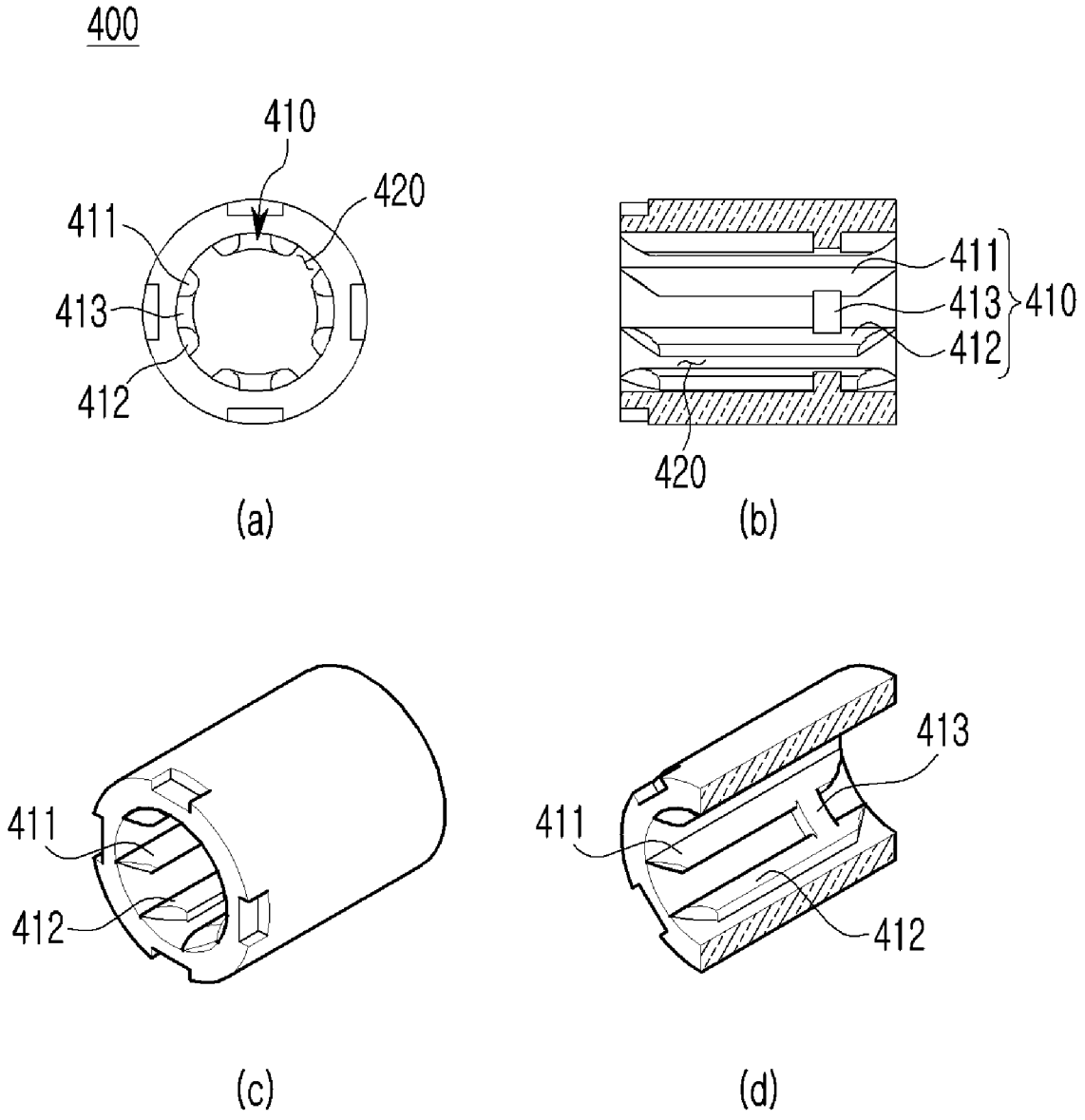
FIG. 7 illustrates a rotator according to the embodiment of the present invention.
Figure 8:
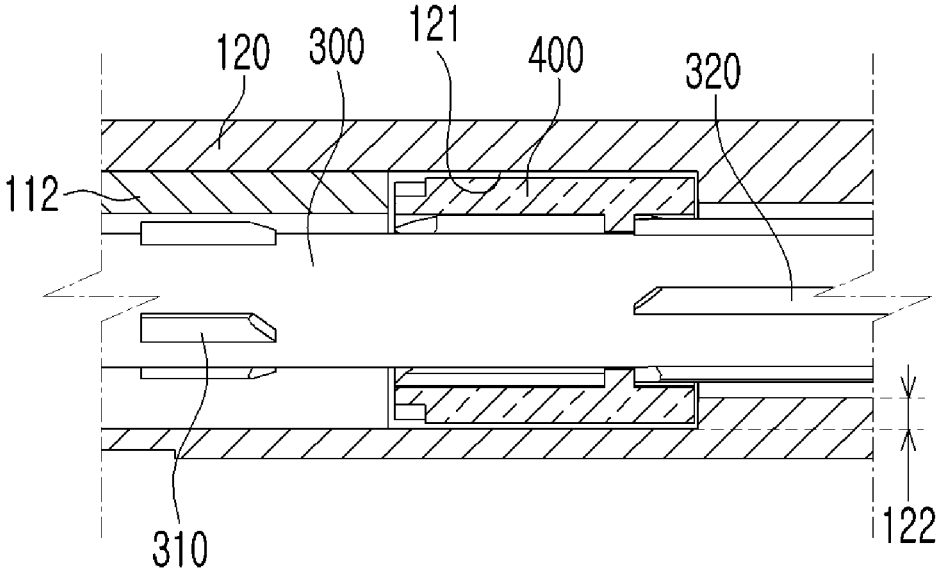
FIG. 8 illustrates an arrangement structure of the shaft and the rotator according to the embodiment of the present invention.
Figure 8:
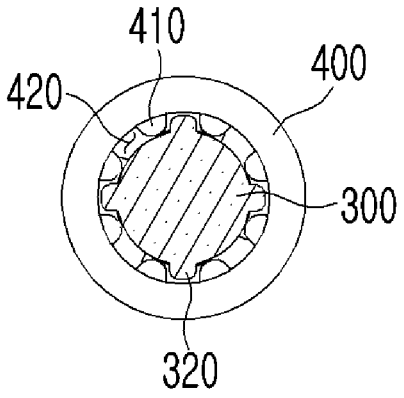

FIG. 1 is a perspective view of a push-to-open device according to an embodiment of the present invention, FIG. 2 is an exploded view of the push-to-open device according to the embodiment of the present invention, FIG. 3 is a front view of the push-to-open device according to the embodiment of the present invention, FIG. 4 is a cutaway view of the push-to-open device according to the embodiment of the present invention, FIG. 5 is an exploded perspective view of a slider and a shaft according to the embodiment of the present invention, FIG. 6 illustrates an operation process when a movable rail is forcibly extracted according to the embodiment of the present invention, FIG. 7 illustrates a rotator according to the embodiment of the present invention, and FIG. 8 illustrates an arrangement structure of the shaft and the rotator according to the embodiment of the present invention.

Referring to FIGS. 1 to 8, a push-to-open device 1000 according to the present invention includes a main body 100, a slider 200, a shaft 300, a rotator 400, and an elastic member 500.

In more detail, the push-to-open device 1000 according to the present invention, which is a push-to-open device mounted on a sliding device having a fixed rail 10 and a movable rail 20 slidably installed on the fixed rail 10, includes the main body 100 mounted on the fixed rail 10 and provided with a guide path 111 and an internal space, the slider 200 installed in the main body 100 to be locked with or unlocked from a locking member 21 of the movable rail 20 and moving along the guide path 111, the shaft 300 of which one end is connected to the slider 200 and the other end is connected to the elastic member 500 provided in the main body 100 and which has a plurality of operation protrusions 310 protruding from an outer circumferential surface thereof and a plurality of locking protrusions 320 protruding from positions spaced a predetermined distance from the operation protrusions 310 in a lengthwise direction, the rotator 400 that is provided in the main body 100, rotates in one direction while engaged with the operation protrusion 310 by movement of the shaft 300 during a pushing operation, and accordingly, is repeatedly locked with and unlocked from the locking protrusion 320, and the elastic member 500 that is provided in the main body 100 and elastically supports a locking or unlocking operation of the shaft 300 and the rotator 400.

The fixed rail 10 is fixed to an inner wall surface of a main body of any of furniture, refrigerators, or various arrangement devices in which a storage body is installed and serves to slidably support the storage body.

The movable rails 20 are installed on both sides of the storage body, are slidably provided on the fixed rail 10, and slidably move together with the storage body in a lengthwise direction thereof. The locking member 21 is provided on one side of the movable rail 20, and the locking member 21 interlocks with a locking groove 210 of the slider 200 during an operation of opening or closing the storage body, and thus is locked or unlocked.

The main body 100 is installed on one side of the fixed rail 10 and may include a body 110 and a housing 120.

In more detail, the main body 100 may include the body 110 mounted on the fixed rail 10, having the guide path 111 formed therein, and having a fastening protrusion 112 provided at one end thereof and the housing 120 into which the fastening protrusion 112 is inserted and coupled and accordingly and which has a rotational space part 121, in which the rotator 400 is rotatably disposed, formed therein.

That is, the fastening protrusion 112 of the body 110 is inserted into and coupled to an internal insertion space of the housing 120, and the rotational space part 121 is formed between an end of the fastening protrusion 112 inserted into the housing 120 and an inner wall step part 122 of the housing 120. The rotator 400 is rotatably disposed in the rotational space part 121.

The guide path 111 of the body 110 guides movement of the slider 200 in an opening direction or a closing direction. The guide path 111 is provided with a straight guide portion 111*a* extending in a lengthwise direction thereof and a curved guide portion 111*b* curved downward at one end of the straight guide portion 111*a*. The straight guide portion

111*a* and the curved guide portion 111*b* serve to guide sliding movement of the slider 200.

The slider 200 is engaged with the locking member 21 of the movable rail 20 to transmit a pushing force in an insertion direction to the shaft 300.

The slider 200 is provided inside the body 110 and partially protrudes toward an upper side of the body 110. The slider 200 is guided by the straight guide portion 111*a* and the curved guide portion 111*b* by being locked with or unlocked from the locking member 21 of the movable rail 20 and thus serves to open or close the storage body while moving in the opening direction or the closing direction.

In this way, the slider 200 that opens or closes the storage body includes the locking groove 210, a locking step 220, a shaft connection groove 230, and a rotation protrusion 240.

In more detail, the slider 200 includes the locking groove 210 that is recessed and locked with or unlocked from the locking member 21, the locking step 220 formed in front of the locking groove 210, and the shaft connection groove 230 into which a head 330 of the shaft 300 is inserted and coupled.

The locking groove 210 is recessed downward and serves to move the slider 200 in the opening direction or the closing direction by being locked with and unlocked from the locking member 21 provided in the movable rail 20.

The locking step 220 is adapted to prevent separation of the locking member 21 and is formed in front of the locking groove 210. However, when the movable rail 20 is forcibly extracted, the locking member 21 is forcibly separated from the slider 200 beyond the locking step 220.

In this case, the locking step 220 includes a first upper inclination portion 221 that allows the locking member 21 to be smoothly separated from the locking groove 210 when the movable rail 20 is forcibly extracted and a second upper inclination portion 222 that allows the locking member 21 to be smoothly inserted into the locking groove 210 when the movable rail 20 is inserted.

Furthermore, the locking step 220 further includes a first side inclination portion 223 that allows the locking member 21 to be smoothly separated from the locking groove 210 when the movable rail 20 is forcibly extracted and a second side inclination portion 224 that allows the locking member 21 to be smoothly inserted into the locking groove 210 when the movable rail 20 is inserted.

Accordingly, when the movable rail 20 is forcibly extracted or inserted, the locking member 21 moves smoothly, and thus damage to components due to the forcible extraction and insertion can be prevented.

The shaft connection groove 230 is recessed in one side surface of the slider 200. The head 330 of the shaft 300 is fitted in and inserted into the shaft connection groove 230.

The rotation protrusion 240 is positioned on the one side surface, protrudes outward, and is installed on the straight guide portion 111*a* to slidably move in an opening direction or a closing direction when the movable rail 20 is opened or closed. When the movable rail 20 is extracted, the rotation protrusion 240 is guided by the straight guide portion 111*a*, slidably moves in the opening direction and thus rotates downward on a side of the curved guide portion 111*b*.

In this process, the locking groove 210 and the locking member 21 are unlocked from each other. Further, when the movable rail 20 is inserted, the rotation protrusion 240 rotates upward, is guided by the straight guide portion 111*a*, and then slidably moves in the closing direction.

One end of the shaft 300 is connected to the slider 200 provided in the body 110, and the other end thereof is connected to the elastic member 500 provided in the housing 120. The head 330 formed at the one end of the shaft 300 is inserted into the shaft connection groove 230 of the slider 200 so that the shaft 300 is coupled to the slider 200. The head 330 may be formed integrally with the one end of the shaft 300.

The shaft 300 transmits the pushing force of the movable rail 20 in the insertion direction to the elastic member 500 and performs a locking and unlocking function through a mutual operation with the rotator 400.

In this case, the elastic member 500 is compressed by the received pushing force and assists the locking and unlocking function while moving the shaft 300 in an extraction direction by an elastic restoring force.

Meanwhile, the shaft 300 includes the plurality of operation protrusions 310 protruding from the outer circumferential surface thereof and the plurality of locking protrusions 320 protruding from positions spaced a predetermined distance from the operation protrusions 310 in the lengthwise direction of the shaft 300.

The operation protrusions 310 are adapted to induce rotation of the rotator 400 in one direction by being engaged with the rotator 400, and at least two operation protrusions 310 are formed on an outer circumferential portion of one side of the shaft 300. Further, the locking protrusion 320 is adapted to repeatedly lock and unlock the rotator 400, and at least two locking protrusions 320 are formed at positions spaced a predetermined distance from the operation protrusions 310 on the outer circumferential portion of the shaft 300. In this case, at least four operation protrusions 310 and locking protrusions 320 may be radially provided on the outer circumferential portion of the shaft 300.

A lengthwise movement of the rotator 400 is restricted by the end of the fastening protrusion 112 of the body 110 and the inner wall step part 122 of the housing 120 and is adapted to rotate in the rotational space part 121.

The rotator 400 may have a hollow cylindrical shape. In this case, the shaft 300 linearly reciprocates in the lengthwise direction while passing through the hollow of the rotator 400, and the rotator 400 rotates about the shaft 300 in the one direction.

That is, the rotator 400 rotates in the one direction while engaged with the operation protrusion 310 by the movement of the shaft 300 in the insertion direction during the pushing operation, and accordingly, is repeatedly locked with or unlocked from the locking protrusion 320.

Meanwhile, the rotator 400 includes a ratchet protrusion 410 and a passage part 420 on an inner circumferential surface thereof.

In more detail, the rotator 400 includes a plurality of ratchet protrusions 410 on the inner circumferential surface thereof and a plurality of passage parts 420 formed between the ratchet protrusions 410. In this case, at least four ratchet protrusions 410 may be radially provided on an inner circumferential portion of the rotator 400.

The ratchet protrusion 410 may be formed in an "H" shape, induce the rotation of the rotator 400 while engaged with the operation protrusion 310, and prevent the movement of the locking protrusion 320 in the extraction direction, thereby serving as a locking component. The passage part 420 is formed between the ratchet protrusions 410 and serves as a movement passage for the locking protrusion 320 in the extraction direction during the unlocking operation.

The ratchet protrusion 410 includes a first ratchet protrusion 411, a second ratchet protrusion 412, and a blocking protrusion 413.

Both ends of the first ratchet protrusion 411 are formed in an oblique shape, one end thereof is engaged with the operation protrusion 310, and the other end thereof is engaged with the locking protrusion 320. The second ratchet protrusion 412 is disposed parallel to the first ratchet protrusion 411, both ends thereof are formed in an oblique shape, one end thereof is engaged with the operation protrusion 310, and the other end thereof is engaged with the locking protrusion 320. The blocking protrusion 413 connects the first ratchet protrusion 411 and the second ratchet protrusion 412 and blocks the movement of the locking protrusion 320 in the extraction direction during the locking operation.

In this case, one end of the operation protrusion 310 may correspond to the oblique shape of the first ratchet protrusion 411 and the second ratchet protrusion 412, and one end of the locking protrusion 320 may correspond to the oblique shape of the first ratchet protrusion 411 and the second ratchet protrusion 412. That is, the operation protrusion 310, the locking protrusion 320, the first ratchet protrusion 411, and the second ratchet protrusion 412 are configured such that ends thereof have oblique surfaces having the same angle.

Accordingly, during the locking and unlocking operations, a rotational movement distance of the rotator 400 is the same, and thus malfunction between the components can be prevented.

Figure 9:
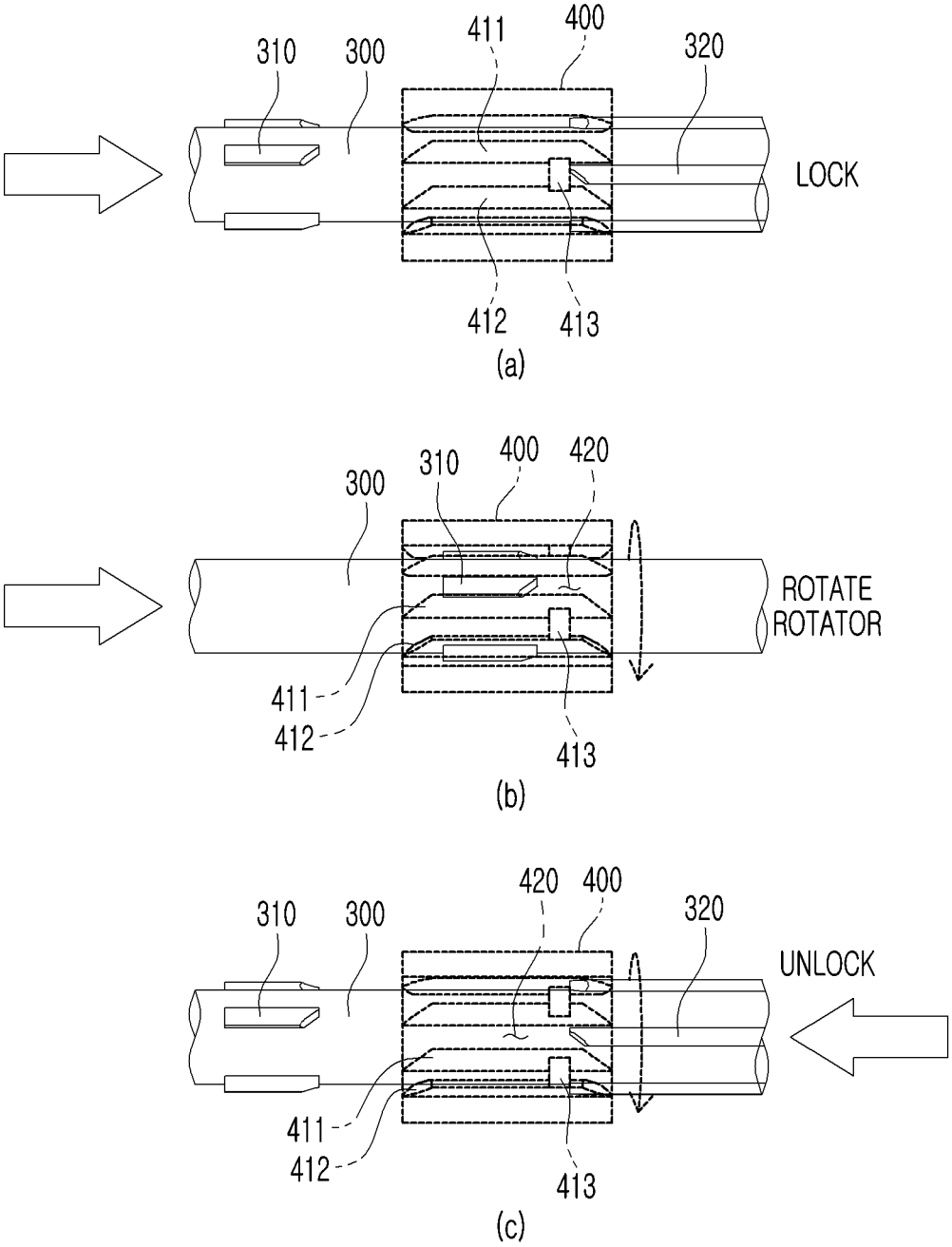
FIG. 9 illustrates a locking and unlocking structure of the shaft and the rotator according to the embodiment of the present invention.
Figure 10:
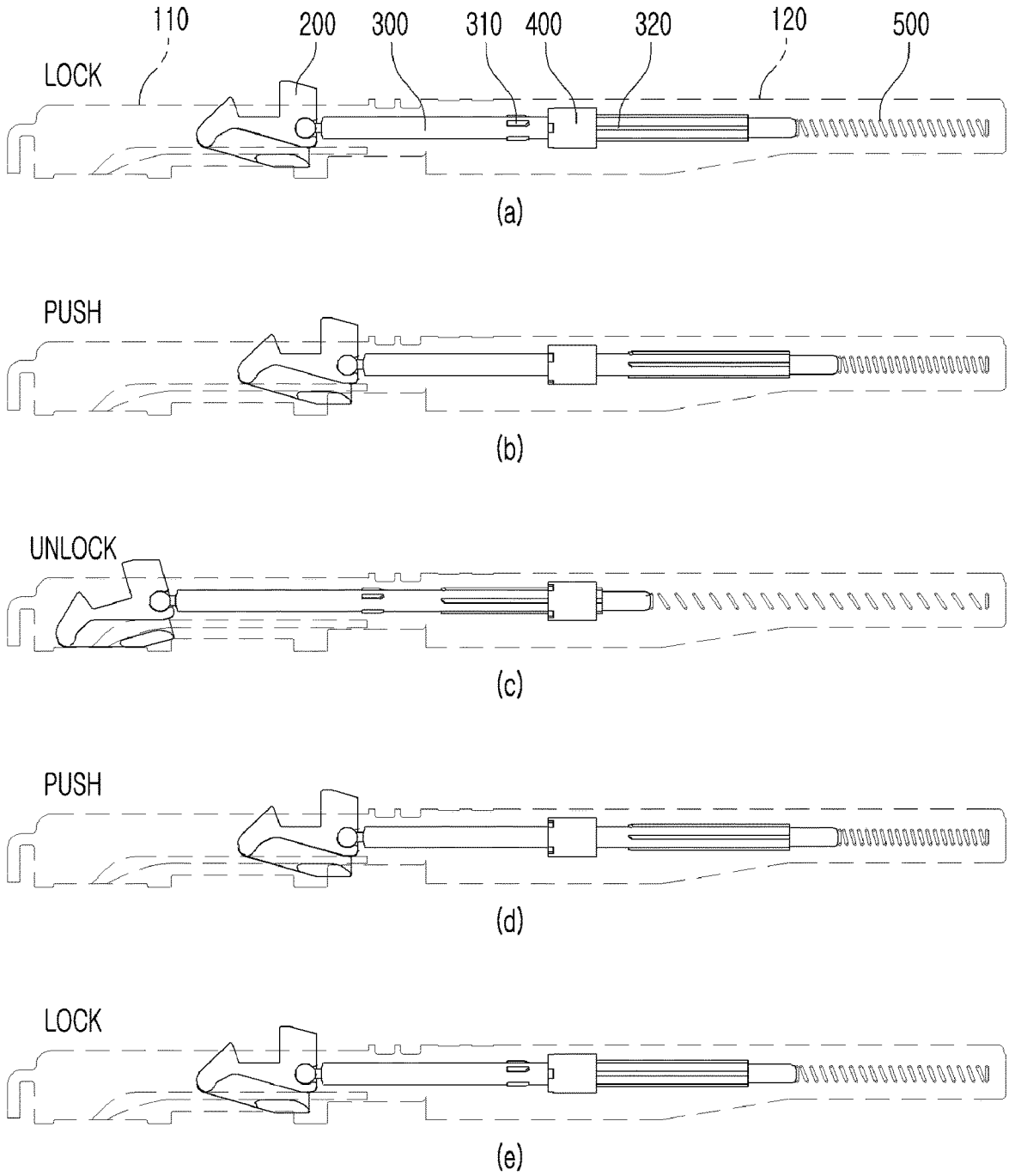
FIG. 10 illustrates an overall operation process of the push-to-open device according to the embodiment of the present invention.

FIG. 9 illustrates a locking and unlocking structure of the shaft and the rotator according to the embodiment of the present invention, and FIG. 10 illustrates an overall operation process of the push-to-open device according to the embodiment of the present invention.

A process of unlocking the push-to-open device will be described with reference to FIGS. 9 and 10.

(1) In a locked state, the locking protrusion 320 of the shaft 300 is blocked from moving in the extraction direction by the blocking protrusion 413 of the rotator 400, and thus the locked state is maintained.

(2) When the shaft 300 is inserted according to the pushing force for unlocking, the oblique surface of the operation protrusion 310 of the shaft 300 is engaged with the oblique surface of one end of the first ratchet protrusion 411, and accordingly, the rotator 400 rotates in the one direction. Further, as the shaft 300 is inserted, the locking protrusion 320 is unlocked from the blocking protrusion 413.

(3) When the pushing force is removed, the shaft 300 is moved in the extraction direction by a reaction force of the elastic member 500. In this case, the oblique surface of the locking protrusion 320 of the shaft 300 is engaged with the oblique surface of the other end of the first ratchet protrusion 411, and accordingly, the rotator 400 rotates in the one direction. Further, by this rotational operation, a path of the locking protrusion 320 of the shaft 300 may coincide with a path of the passage part 420 of the rotator 400, and the locking protrusion 320 may move in the extraction direction through the passage part 420.

The above description of the present invention is merely illustrative, and those skilled in the art to which the present invention pertains can understand that the present invention can be easily modified in other specific forms without changing the technical spirit or essential features of the present invention. Therefore, it should be understood that the embodiments described above are illustrative but not limiting in all aspects. For example, components described as a single type may be implemented in a distributed manner, and likewise, components described as a distributed manner may also be implemented in a coupled form.

The scope of the present invention is indicated by the appended claims, and all changes or modifications derived from the meaning and scope of the appended claims and equivalent concepts thereof should be construed as being included in the scope of the present invention.

DESCRIPTION OF REFERENCE NUMERALS

1000: Push-to-open device
100: Main body
110: Body
120: Housing
200: Slider
210: Locking groove
220: Locking step
230: Shaft connection groove
240: Rotation protrusion
300: Shaft
310: Operation protrusion
320: Locking protrusion
330: Head
400: Rotator
410: Ratchet protrusion
420: Passage part
500: Elastic member

The invention claimed is:

1. A push-to-open device mounted on a slide device having a fixed rail and a movable rail slidably installed on the fixed rail, the push-to-open device comprising:

a main body mounted on the fixed rail and having a guide path and an internal space;

a slider that is provided on the main body to be locked with or unlocked from a locking member of the movable rail and moves along the guide path;

a shaft of which one end is connected to the slider and the other end is connected to an elastic member provided in the main body and which has a plurality of operation protrusions protruding from an outer circumferential surface thereof and a plurality of locking protrusions protruding from positions spaced a predetermined distance from the operation protrusions in a lengthwise direction;

a rotator that is provided in the main body, rotates in one direction while engaged with the operation protrusion by movement of the shaft during a pushing operation, and accordingly, is repeatedly locked with and unlocked from the locking protrusion; and the elastic member that is provided in the main body, elastically supports a locking or unlocking operation of the shaft and the rotator, wherein the rotator includes:

a plurality of ratchet protrusions formed in an "H" shape on an inner circumferential surface of the rotator; and a plurality of passages formed between the ratchet protrusions.

2. The push-to-open device of claim 1, wherein the slider includes a locking groove that is recessed and locked with or unlocked from the locking member, a locking step formed in front of the locking groove, and a shaft connection groove into which a head of the shaft is inserted and coupled.

3. The push-to-open device of claim 2, wherein the locking step includes a first upper inclination portion configured to allow the locking member to be smoothly separated from the locking groove when the movable rail is forcibly extracted.

4. The push-to-open device of claim 3, wherein the locking step further includes a first side inclination portion configured to allow the locking member to be smoothly separated from the locking groove when the movable rail is forcibly extracted.

5. The push-to-open device of claim 1, wherein the ratchet protrusions include:

a first ratchet protrusion of which both ends are formed in an oblique shape and which is engaged with the operation protrusions and the locking protrusions;

a second ratchet protrusion which is disposed parallel to the first ratchet protrusion, of which both ends are formed in an oblique shape, and which is engaged with the operation protrusions and the locking protrusions; and a blocking protrusion which connects the first ratchet protrusion and the second ratchet protrusion and with which the locking protrusion is locked during a locking operation.

6. The push-to-open device of claim 5, wherein one end of the operation protrusion is formed to correspond to the oblique shapes of the first ratchet protrusion and the second ratchet protrusion, and one end of the locking protrusion is formed to correspond to the oblique shapes of the first ratchet protrusion and the second ratchet protrusion.

7. The push-to-open device of claim 1, wherein the main body includes:

a body mounted on the fixed rail, having the guide path formed therein, and having a fastening protrusion provided at one end thereof; and a housing into which the fastening protrusion is inserted and coupled, and accordingly, which has a rotational space part, in which the rotator is rotatably disposed, formed therein.

8. The push-to-open device of claim 7, wherein the guide path includes:

a straight guide portion extending in a lengthwise direction thereof; and a curved guide portion extending to be curved downward at one end of the straight guide portion.

* * * * *